US005370308A

United States Patent [19]

Black

[11] Patent Number: 5,370,308

[45] Date of Patent: Dec. 6, 1994

[54] MODULAR SUPPORT STRUCTURE FOR SCALE-MODEL RAILROAD TRACK

[76] Inventor: Joseph E. Black, 24561 Ladera Dr., Mission Viejo, Calif. 92691

[21] Appl. No.: 65,165

[22] Filed: May 20, 1993

[51] Int. Cl.[5] ..... E01B 23/00

[52] U.S. Cl. ..... 238/10 R; 238/10 E; 104/111; 104/123

[58] Field of Search ..... 104/111, 123, 126, 124; 238/10 R, 10 E, 10 A, 10 F, 10 B; D21/143, 141

[56] References Cited

U.S. PATENT DOCUMENTS

| | | | |
|---|---|---|---|
| D. 226,571 | 3/1973 | Spiegel | D21/143 |
| D. 262,048 | 11/1981 | Kato | D21/143 |
| D. 305,676 | 1/1990 | Ngai | D21/143 |
| D. 325,758 | 4/1992 | Black | D21/143 |
| 983,615 | 2/1911 | Ferris | 104/111 |
| 1,018,931 | 2/1912 | Scott et al. | 104/111 |
| 1,085,649 | 2/1914 | Webber | 104/123 |
| 1,655,123 | 1/1928 | Badger | 104/111 |
| 2,562,406 | 7/1951 | Barker | 104/111 |
| 3,540,153 | 11/1970 | Aoki | 238/10 A |
| 5,085,148 | 2/1992 | Konno | 238/10 A |
| 5,203,733 | 4/1993 | Patch et al. | 238/10 R |

OTHER PUBLICATIONS

Brochure From Overhead Railways By Joe Black consisting of 4 color pages including photographs and customer endorsements (no date).

*Primary Examiner*—Mark T. Le
*Attorney, Agent, or Firm*—Stetina Brunda & Buyan

[57] ABSTRACT

A modular support structure for scale-model railroad tracks utilizes a plurality of planks, a plurality of suspension members for suspending at least some of said planks from an architectural structure, and a plurality of rails interconnecting said planks. The rails and planks define a modular support structure suitable for supporting a scale-model railroad track. The modular support structure is easily installed with a minimum of labor. The modular support structure optionally utilizes a plurality of support members for supporting at least some of said planks above a surface, such as soil, stone, concrete, floors, etc.

13 Claims, 4 Drawing Sheets

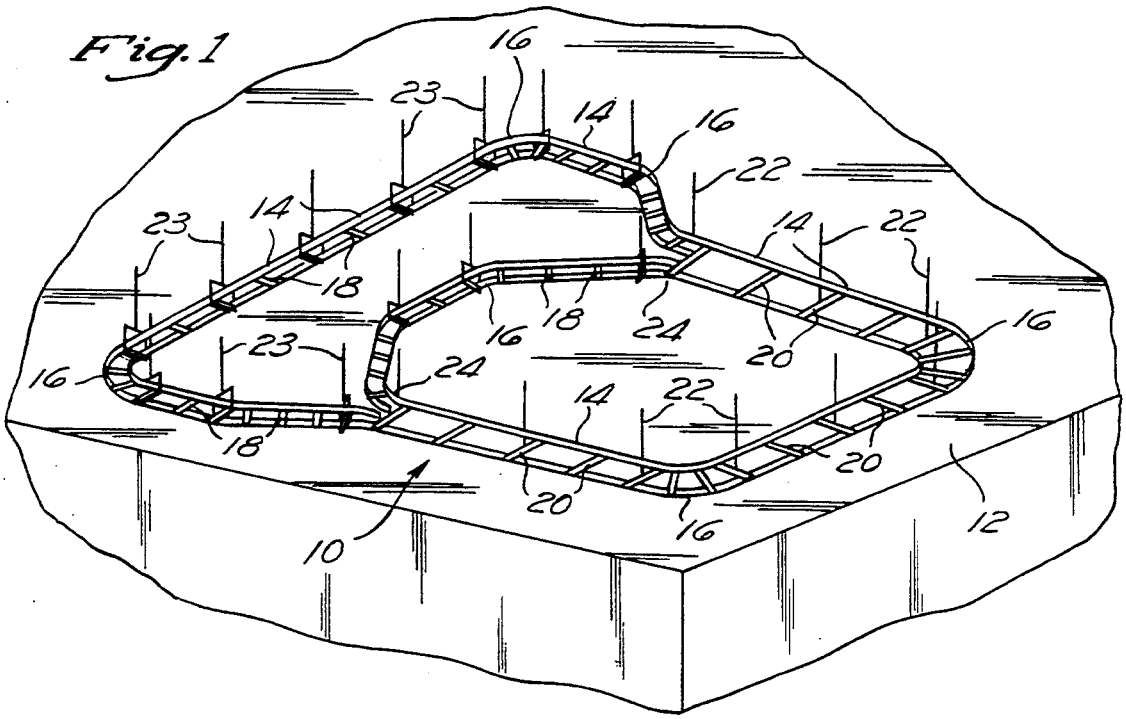
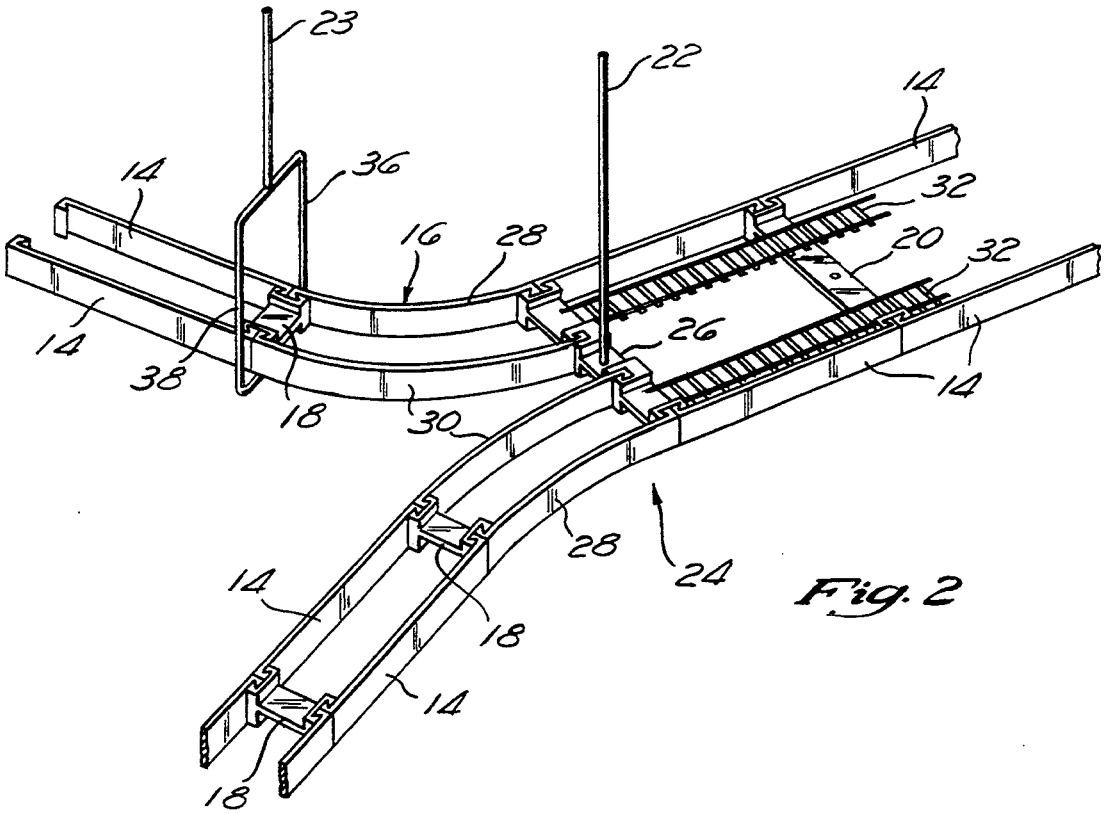
Fig. 2

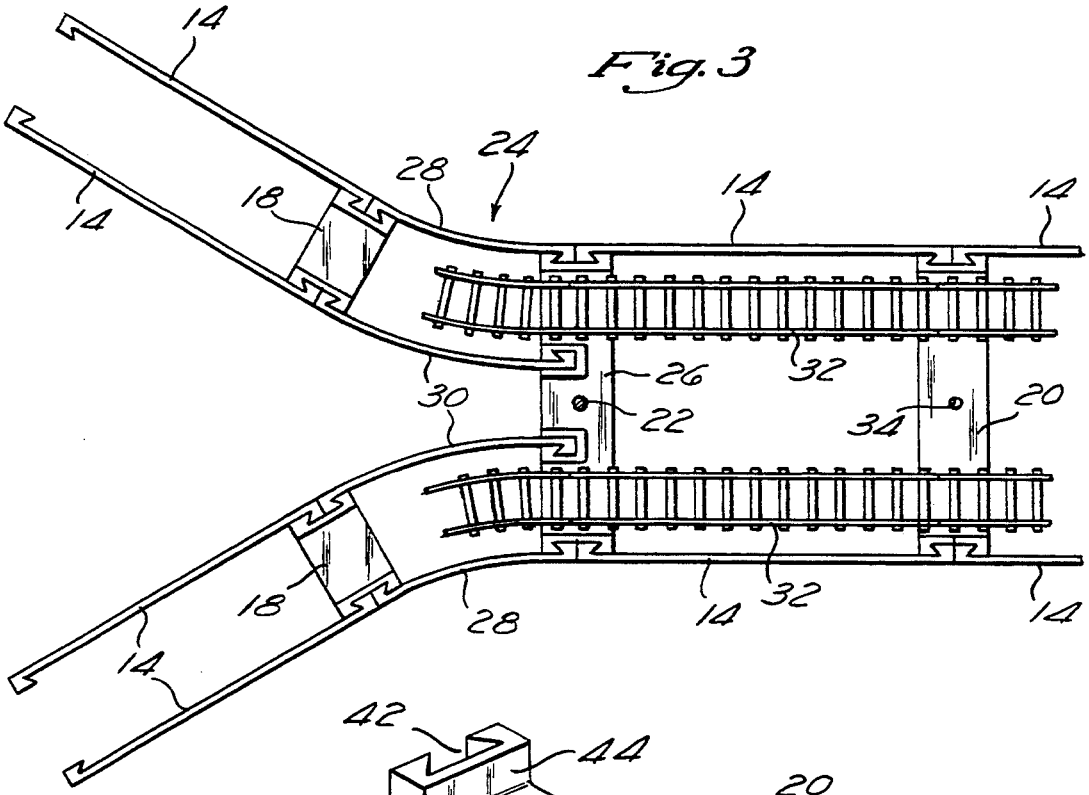
Fig. 3
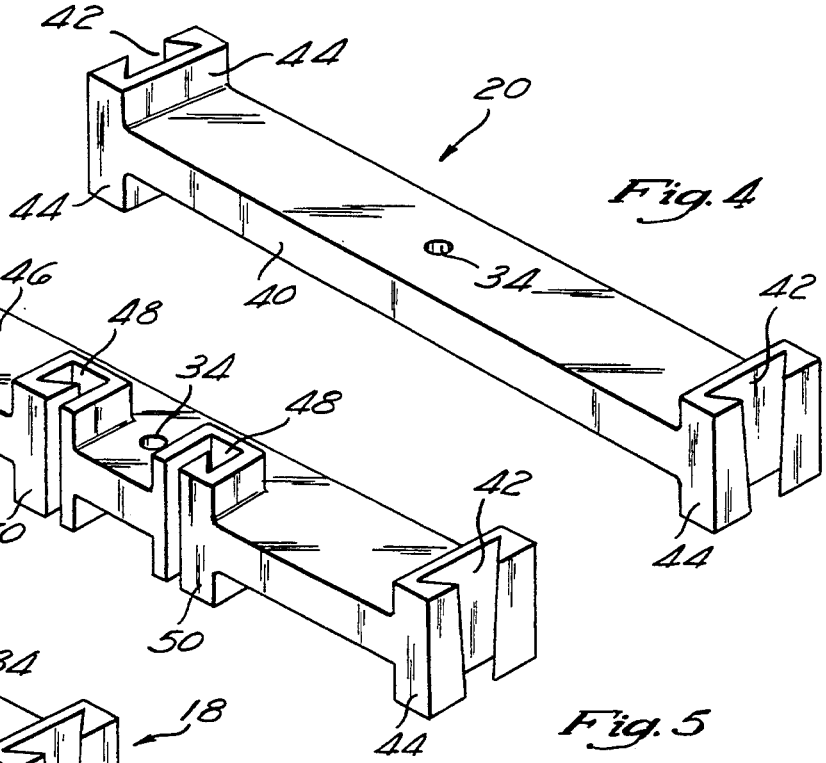
Fig. 4
Fig. 5
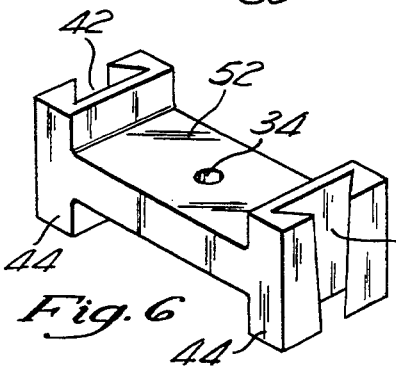
Fig. 6

Fig. 13
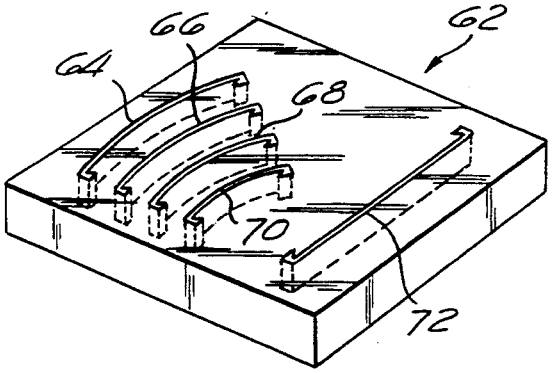
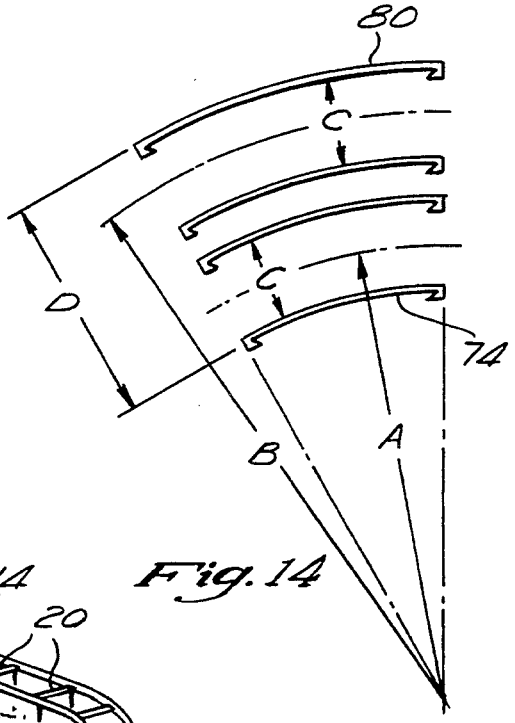
Fig. 14
Fig. 15
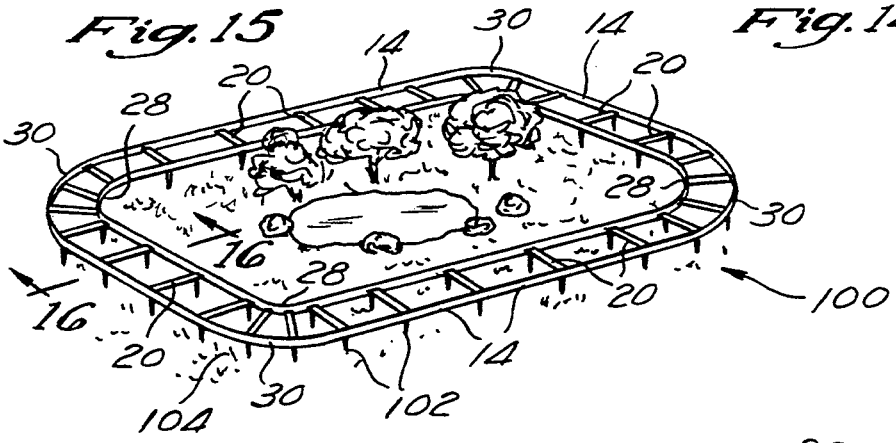
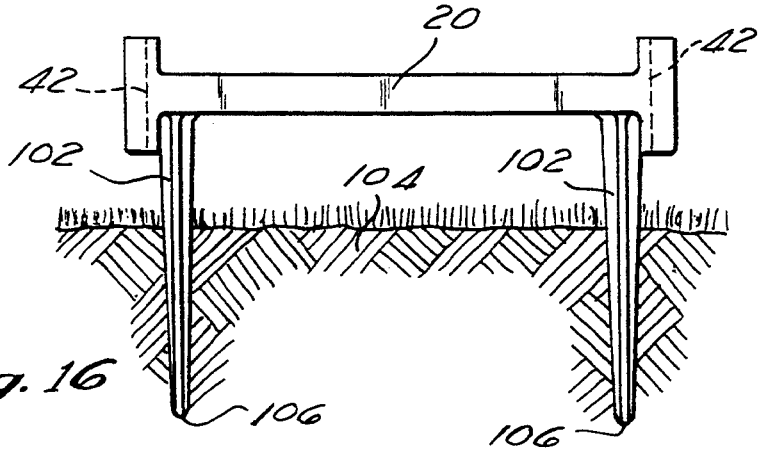
Fig. 16

MODULAR SUPPORT STRUCTURE FOR SCALE-MODEL RAILROAD TRACK

FIELD OF THE INVENTION

The present invention relates generally to scale-model railroads, and more particularly to a modular support structure for scale-model railroad track wherein the railroad track is suspended from an architectural structure, such as a ceiling, or is supported above a surface, such as the ground, a floor, concrete pavement, stone, etc.

BACKGROUND OF THE INVENTION

Model railroads are well known. Generally, model railroad tracks are constructed upon a support surface such as one or more sheets of plywood. Such model railroad tracks typically comprise single and double sections of track formed in both straight and curved sections and configured in various shapes, i.e. figure eight, circular, oval, etc.

It is becoming increasingly more popular to suspend model railroad tracks from architectural structures, such as ceilings, within restaurants, retail outlets, and homes. The installation of model railroad tracks within restaurants, retail outlets, homes, and the like is aesthetically pleasing and adds substantially to the enjoyment of being in such places. Diners, customers, friends, and relatives all enjoy watching model trains travel upon such tracks.

However, suspending model railroad tracks from architectural structures requires custom installation involving construction of the track support structure and attachment thereof to the architectural structure, typically via suspension members. Thus, each track must be individually designed, fabricated, and installed specifically to suit its particular location.

The design and fabrication of such custom model railroad tracks is extremely labor intensive and thus very expensive. Additionally, the installation of the fabricated track support structure is difficult and time consuming. Thus, it would be beneficial to provide a modular support structure for scale-model railroad tracks wherein prefabricated pieces are attached together to define a desired track configuration which is easily installed with a minimum of labor.

Additionally, it is frequently desirable to install scale-model railroad track outdoors, such as in garden environments, for example. Thus, it would similarly be beneficial to provide prefabricated modular support structures for supporting scale-model railroad tracks above such surfaces as soil, stone, concrete, floors, etc.

As such, although the prior art has recognized to a limited extent the problem of providing support structures for scale-model railroad track, the proposed solutions have, to date, been ineffective in providing a satisfactory remedy.

SUMMARY OF THE INVENTION

The present invention specifically addresses and alleviates the above-mentioned deficiencies associated with the prior art. More particularly, a first embodiment of the present invention comprises a modular support structure for scale-model railroad track comprising a plurality of planks, a plurality of suspension members for suspending at least some of the planks from an architectural structure, such as a ceiling, and a plurality of rails interconnecting the planks so as to define a support structure suitable for supporting a scale-model railroad track. The rails are easily attachable to the planks such that a modular support structure is provided. Thus, using standardized components, a support structure can readily be provided with a minimum of labor and costs.

The rails and planks are preferably formed by the injection molding of a plastic material. However, those skilled in the art will recognize that various other materials and means of manufacture are likewise suitable.

The rails preferably comprise a plurality of straight rails and a plurality of curved rails, the curved rails preferably being of approximately 30 degrees of arc. By utilizing curved rails of approximately 30 degrees of arc, turns of 30, 60, 90, 120, 150, and 180 degrees can easily be constructed. Those skilled in the art will recognize that curved rails of various other angles are likewise suitable. More particularly, various other angles may be desirable for use with various different scales of model railroad track.

The straight rails are preferably approximately 18 inches in length. Optionally, straight rails of 6, 12, and 24 inches may be provided. Those skilled in the art will recognize that various other lengths of straight rails are likewise suitable.

Each of the planks preferably comprise an elongate member having first and second ends, each of the first and second ends being configured to removably attach to two rails such that the planks are disposed intermediate two parallel series of rails in a train track-like fashion, one series on either side of the planks. That is, the construction of the planks and rails resembles and is generally analogous to the construction of the rails and the railroad ties of a train track.

The planks preferably comprise double female dovetails formed at the first and second ends thereof. The first and second ends of the planks are preferably thicker than the interconnecting elongate member so as to accommodate the double female dovetails. The rails preferably have first and second ends and preferably comprise complimentary single male dovetails formed at the first and second ends thereof such that abutted male dovetails of two adjacent rails are complimentary to the double female dovetails of said planks. Thus, the abutted male dovetails of two adjacent rails are receivable within the double female dovetails of the planks, thereby facilitating removable attachment of the rails to the planks.

The double female dovetails of the planks are preferably tapered such that they have a greater cross-sectional area at the top thereof than at the bottom thereof and the male dovetails are preferably similarly tapered such that the abutted male dovetails of two adjacent rails are snugly receivable within the double female dovetails. Tapering of the double female dovetails of the planks and similar tapering of the male dovetails of the rails prevents the male dovetails of the rails from falling through the female dovetails of the planks. Those skilled in the art will recognize that various other configurations of the rails and the planks are likewise suitable for facilitating modular attachment thereof wherein the rails do not become undesirably detached from the planks during use.

The suspension members preferably comprise elongate metal members, preferably formed of brass, which are attachable to the architectural structure, i.e. ceiling, walls, support columns, etc., and which hang downwardly therefrom and attach to the planks.

The suspension members may alternatively be configured to extend outwardly from a wall or other substantially vertical architectural surface, rather than extending downwardly from a ceiling. Additionally, such generally horizontal members may likewise be utilized to support or stabilize a modular support structure which is supported by vertical suspension members depending from a ceiling.

In the preferred embodiment of the present invention, the lower-most ends of the suspension members are threaded such they pass through apertures formed in at least some of the planks and are secured to the planks via nuts. Washers may additionally be used intermediate each nut and plank. Thus, at least some of the planks are supported by elongate metal suspension members passing therethrough and the planks are held in place with nuts threaded onto the ends of the elongate suspension members. Those skilled in the art will recognize that the number of suspension members required depends upon the weight, i.e. gauge, of the model train and track being supported thereby, as well as by the tensile strength of the suspension members.

Both sections of double-wide and single-wide support structure, as well as Y's are provided. The sections of double-wide support structure are preferably supported by the suspension members via apertures formed in the center of at least some of the planks as discussed above. The single-wide sections are preferably suspended via apertures, indentations, or other attachment means formed at either end thereof, such that two suspension members, or a single Y-shaped suspension member, may be utilized for the support thereof. Alternatively, every other plank for which support is provided may be supported at an opposite end thereof such that alternating ends of the planks are supported thereby.

One or more Y-planks facilitate splitting of a double-wide section of the modular support structure into two single-wide sections thereof. Each Y-plank comprises an elongate member having first and seconds ends. Double female dovetails are formed at the first and second ends of each of the elongate members of the Y-plank, as discussed above. The double female dovetails facilitate attachment of two rails of a double-wide section thereto. Two single female dovetails are formed intermediate the first and second ends. The single dovetails facilitate the additional attachment of two inside rails, one for each of the two single-wide sections.

In a second embodiment of the present invention, the suspension members are replaced with a similar plurality of support members for supporting at least some of the planks above a surface, such as soil, stones, gravel, pavement, concrete, floor, etc. Thus, the scale-model railroad track may be installed outdoors, i.e. in a yard, garden, parking lot, etc.

Each support member preferably comprises at least one vertical support, wherein the lower end of each vertical support is pointed so as to penetrate the ground. Alternatively, flat plates or feet may be formed upon the lower ends of each support member such that the support member may readily be utilized upon hard surfaces, such as pavement or floors.

In the preferred embodiment of the present invention, the support member preferably comprises two vertical supports, the lower end of each vertical support either being pointed so as to penetrate the ground or having feet formed thereupon to facilitate use on hard surfaces, as discussed above. The supports may either be permanently attached to, formed as a part of, or removably attached to the planks.

Both the first and second embodiments of the present invention thus facilitate the construction of a support structure for scale-model railroad track utilizing far less labor than required in contemporary custom construction. Indeed, the use of tools is additionally minimized and costs considerably reduced. Thus, many installations may be provided where they were otherwise cost prohibitive.

To construct a support structure for scale-model railroad track according to the present invention, the user first decides upon a particular desired design. Then, modular track portions, i.e. planks, Y-planks, straight sections and curved sections are purchased to conform to the desired design. A sufficient number of suspension members (first embodiment) or support members (second embodiment) are likewise purchased. The support structures are assembled by inserting the abutted ends of adjacent male dovetails into the double female dovetails of each plank member, by hand. Thus, tools are not required for the assembly of the rails and planks. The male dovetails of the rails may be permanently joined to the female dovetails of the planks via adhesive bonding or the use of fasteners, if desired.

In the practice of the first embodiment of the present invention, the suspension members are attached at appropriate intervals such that they depend from the ceiling or other architectural structure and attach to at least some of the planks. The modular support structure is attached to the suspension members by inserting the ends of the suspension members through apertures formed in the planks and then threading nuts upon the threaded ends of the support members. Washers may optionally intermediate the nuts and planks. Alternatively, particularly for the single-wide planks, the suspension members may attach to the ends or underside of the planks.

In larger installations, sections of the modular support structure may be formed and then attached to the suspension members, thus building the support structure one small portion at a time. In small installations, the entire support structure may first be assembled, and subsequently suspended from the suspension members.

In the practice of the second embodiment of the present invention, the planks and rails are interconnected as in the first embodiment thereof and support members for supporting at least some of the planks above a surface are substituted for the suspension members. Feet are provided at the lower-most ends of the support members, if desired. Thus, the modular support structure of the present invention may be utilized upon various types of surfaces.

A single set of injection molds may be utilized to simultaneously form a plurality of track sections, curved and/or straight, at one time by forming a plurality of cavities within the molds. The planks may optionally be formed simultaneously with the rails, thereby further lowering the cost of production.

These, as well as other, advantages of the present invention will be more apparent from the following description and drawings. It is understood that changes in the specific structure shown and described may be made within the scope of the claims without departing from the spirit of the invention.

BRIEF DESCRIPTION OF THE DRAWINGS

FIG. 1 is a perspective view of the modular support structure for scale-model railroad track of the present invention suspended from a ceiling, according to a first embodiment thereof;

FIG. 2 is an enlarged perspective view of a Y-intersection of FIG. 2;

FIG. 3 is a top plan view of the Y-intersection of FIG. 2;

FIG. 4 is an enlarged perspective view of a double-wide plank of FIG. 1;

FIG. 5 is an enlarged perspective view of a Y-plank of FIG. 1;

FIG. 6 is an enlarged perspective view of a single-wide plank of FIG. 1;

FIG. 13 is a perspective view of a mold, showing the cavities formed therein such that the curved rails and straight rail may be formed within the cavities via injection molding;

FIG. 14 provides the preferred radii of the curved rails, according to the preferred embodiment of the present invention;

FIG. 15 is a perspective view of the modular support structure for scale-model railroad track, according to a second embodiment thereof; and FIG. 16 is an end view of a support member of FIG. 15, intended for use outdoors.

DETAILED DESCRIPTION OF THE PREFERRED EMBODIMENT

Figure 7:
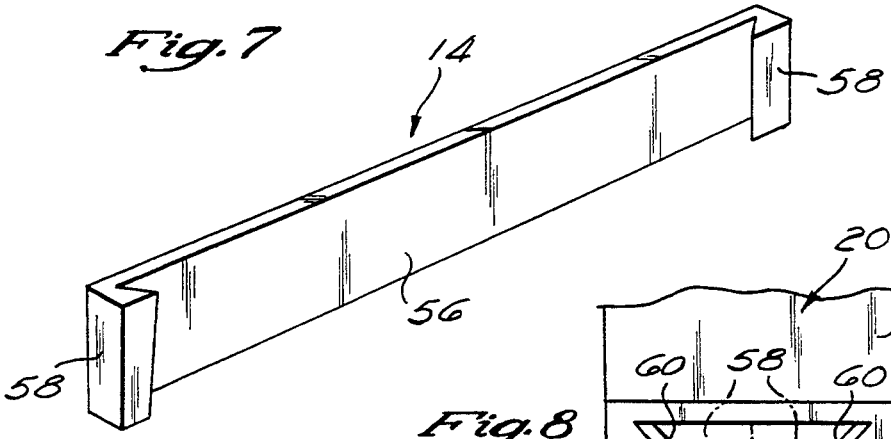
FIG. 7 is an enlarged perspective view of a straight rail section of FIG. 1.
Figure 8:
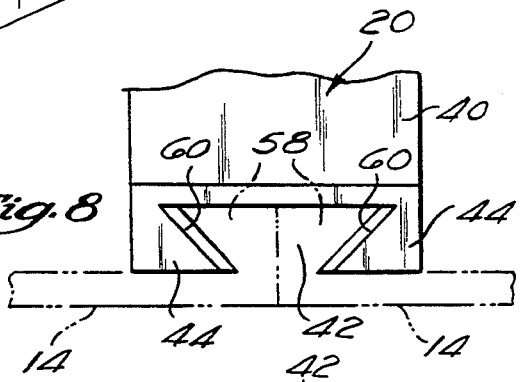
FIG. 8 is a sectional enlarged plan view of one end of either a double-wide plank, a Y-plank, or a single-wide plank, showing the dovetail formed therein.
Figure 10:
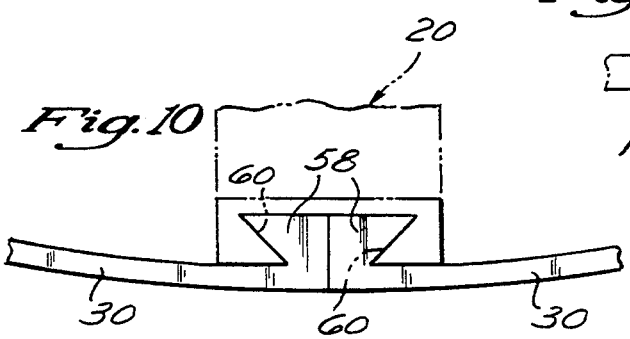
FIG. 10 is a top plan view of the end of the plank of FIG. 8, showing two abutting ends of adjacent rails inserted into the dovetail thereof.
Figure 9:
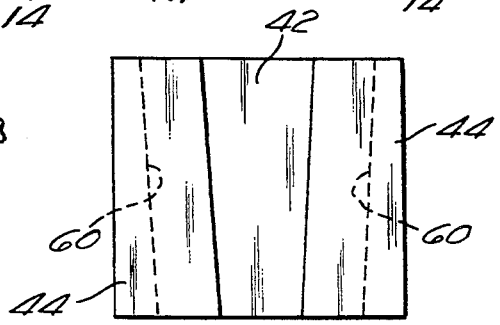
FIG. 9 is an end elevation view of the dovetail of the plank of FIG. 8.
Figure 11:
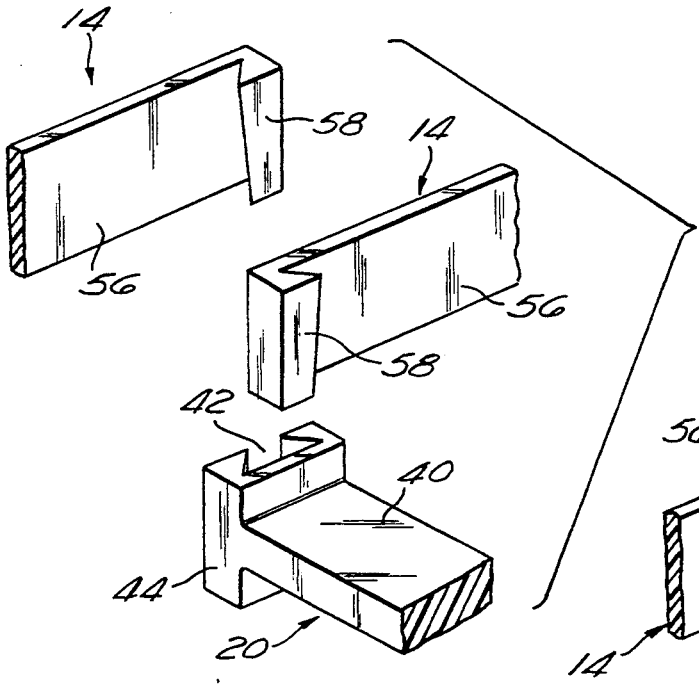
FIG. 11 is an exploded perspective view of the end of the plank and abutting ends of the rails of FIG. 10.
Figure 12:
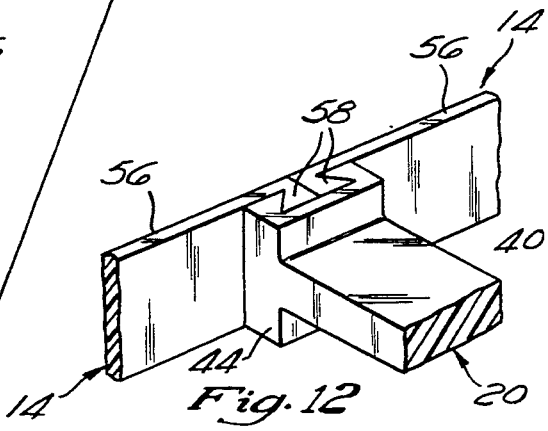
FIG. 12 is a perspective view of the plank end and abutting rails of FIG. 10.

The detailed description set forth below in connection with the appended drawings is intended as a description of the presently preferred embodiments of the invention, and is not intended to represent the only forms in which the present invention may be constructed or utilized. The description sets forth the functions and sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The modular support structure for scale-model railroad track of the present invention is illustrated in FIGS. 1–16 of the drawings which depict two presently preferred embodiments of the invention. Referring now to FIG. 1, the modular support structure for scale-model railroad track 10 is suspended from a ceiling 12 and generally comprises a plurality of straight 14 and curved 16 rails spaced apart via single-wide cross members or planks 18 or by double-wide cross members or planks 20. A plurality of bifurcated suspension members 23 and straight suspension members 22 depend from the ceiling 12, to which they are attached, and further attach to the single-wide planks 18 and the double-wide planks 20, respectively.

Y-intersections 24 facilitate the joining of two single-wide track supports to one double-wide track support such that two individual sets of tracks may come together and run in a parallel fashion beside one another.

Referring now to FIGS. 2 and 3, each Y-intersection 24 comprises a Y-plank 26 having a single pair of rails, in this instance straight rails 14, attached to one side thereof and having two pairs of rails, in this instance curved rails, i.e., inside curved rails 28 and outside curved rails 30, attached to the second side thereof. Thus, two generally parallel railroad tracks 32 are accommodated by the double-wide portion of the modular support structure for the scale-model railroad track of the present invention and a single railroad track 32 is accommodated by each of the single-wide portions thereof.

Straight suspension members 22 attach at their lowermost ends to at least some of the double-wide planks 20 and/or the Y-planks 26 to provide support thereto. The straight suspension members 22 are received within through holes or apertures 34 formed in the double-wide planks and the Y-planks and, in the preferred embodiment of the present invention, have nuts threaded thereon. Washers may optionally be disposed intermediate the nuts and the double-wide 20 or Y 26 planks to more evenly distribute the load applied thereto. Those skilled in the art will recognize that various other means are likewise suitable for attaching the lower-most ends of the straight suspension members 22 to the double-wide 20 and Y 26 planks.

Bifurcated suspension members 23, having first 36 and second 38 forks, support the single-wide planks 18 and attach to the underside thereof. In the preferred embodiment of the present invention, the distal ends of the forks 36 and 38 are received within apertures or indentations formed within the lower surface of the single-wide planks 18. The support members for the single-wide sections of scale-model railroad track may optionally comprise a single forked member, rather than a bifurcated suspension member 23, as illustrated. That is, one of the two forks 36, or 38, may optionally be omitted. Those skilled in the art will recognize that various other means are likewise suitable for attaching the forks 36 and 38 to the single-wide planks 18.

Referring now to FIG. 4, a double-wide plank 20 comprises an elongate cross member 40 having an aperture 34 formed through the center thereof and having tapered double female dovetails 42 formed at either end thereof. The tapered double female dovetails 42 are preferably formed within an area of increased thickness 44, i.e., having a thickness greater than that of the elongate cross member 40. Each of the tapered double female dovetails 42 has a greater cross-sectional area toward the upper-most end thereof than toward the lower-most end thereof, such that a corresponding male tapered dovetail may be received through the upper-most end thereof and not pass therethrough and out the lower-most end thereof. The double-wide plank 20 is utilized to support double track sections, i.e., two generally parallel track sections.

Referring now to FIG. 5, a Y-plank 26 similarly comprises an elongate cross member 46 having an aperture 34 formed therethrough and having tapered double female dovetails 42 formed at the ends thereof. Additionally, the Y-plank 26 further comprises two intermediate single tapered dovetails 48 for receiving the two inner-most rails of the modular support structure. The tapered double female dovetails 42 receive the two outer-most rails thereof. In a fashion similar to the tapered double female dovetails 42, the tapered single female dovetails 48 are preferably formed upon areas of increased thickness 50.

Referring now to FIG. 6, a single-wide plank 18 comprises an elongate cross member 52 having an aperture formed therethrough and also having tapered double female dovetails 54 formed at the ends thereof. The cross member 52 of the single-wide plank 18 is approximately one-half as long as the double-wide plank 20. The single-wide plank 18 is utilized to support single lengths of scale-model railroad track, i.e., a single track as opposed to double tracks.

The double-wide planks 20, the Y-planks 26, and the single-wide planks 18 may optionally be formed of honeycomb or cored material, so as to improve plastic management. Such construction substantially reduces the quantity of plastic required to produce each individual component, thereby lowering the cost thereof. Additionally, such reduction in the quantity of plastic utilized reduces cooling time, thereby facilitating a more rapid injection molding process. The area of increased thickness 44 of the double-wide planks 20, Y-planks 26, and single-wide planks 18 are preferably formed of such honeycomb or cored material. Optionally, the elongate cross members 40, 46, and 52, respectively, may likewise be formed of honeycomb or cored material.

Referring now to FIG. 7, a straight rail member 14 is comprised of an elongate portion 56 and a tapered male dovetail 58 formed upon either end thereof. The tapered male dovetails 58 are configured such that they fit snugly into the tapered single female dovetails 48 and such that two abutted tapered single male dovetails 58 fit snugly into a single tapered female tapered double female dovetail 42.

Referring now to FIGS. 8–12, tapered double female dovetails 42 comprises inclined surfaces 60 which taper toward one another from top to bottom such that the tapered double female dovetail 42 has a larger cross-sectional area toward the top thereof and a smaller cross-sectional area toward the bottom thereof so as to prevent the abutted tapered single male detents 58 received therein from passing therethrough and falling out the bottom thereof. Thus, the tapered single male dovetails 58 are captured within the tapered double female dovetail 42, thereby securely engaging the rails 14, 28, or 30 with the planks 18, 20, and 26. Those skilled in the art will recognize that various other configurations for removably attaching the rails 14, 28, and 30 to the planks 18, 20, and 26 are likewise suitable.

Referring now to FIG. 13, a single mold half 62, preferably for use in the injection molding of a plastic material, has a plurality of curved rail cavities 64, 66, 68, and 70, and also has a straight rail cavity 72 formed therein. The nested configuration of the curved rail cavities 64, 66, 68, and 70 optimizes the placement efficiency thereof within the mold half 62, thereby minimizing the costs associated with injection molding of these components. Thus, a plurality of components, i.e., various curved and/or straight sections, are molded with each cycle of an injection molding apparatus.

Referring now to FIG. 14, the curved track sections are preferably formed to extend approximately thirty degrees in arch length and are preferably configured to provide a short radius A, for the inner track, of approximately 23.75 inches and a long radius B, for the outer track, of approximately 30.75 inches. The distance between rails for a given track C is preferably approximately 5 inches and the distance D between the inner-most track 74 and the outer-most track 80 is preferably approximately 12 inches. Each rail is preferably approximately 0.25 inch thick.

Having thus described the structure of the first embodiment of the modular support structure for scale-model railroad track of the present invention, it may be beneficial to describe the use thereof. The suspension members 22 and 23 are attached at appropriate intervals to the ceiling such that they depend therefrom and will attach to at least some of the planks 20, 26, and/or 18, as desired. The modular support structure is attached to the suspension members 22 and 23 by inserting the lower-most ends of the suspension members 22 through the apertures formed in the planks 20 and 26. The bifurcated suspension members 23 are attached to the single-wide planks 18 by inserting the lower-most ends thereof into apertures formed in the bottom surface of the single-wide planks 18. Nuts are threaded onto the lower-most ends of the straight suspension members 22 to secure them to the planks 20 or 26.

The modular support structure may be assembled in sections, each section then being attached to the suspension members 22 and/or 23, so as to form the completed modular support structure, one portion at a time.

The support structure is formed by inserting the single male dovetails 58 of adjacent straight rails 14 and/or curved rails 30 or 28 into the tapered double dovetails 42 of the double-wide 20 and/or Y 26 planks, as desired. The single male dovetails 58 may be adhesively bonded into the tapered double female dovetails 42. Alternatively, fasteners, i.e., nails, screws, etc. may be utilized to further secure the single male dovetails 58 into the tapered double female dovetails 42.

Referring now to FIGS. 15 and 16, in a second embodiment of the modular support structure for scale-model railroad track of the present invention, the scale-model railroad track is supported above a surface, i.e. the ground, pavement, concrete, etc., such that it may readily be used indoors or outdoors, as desired. The modular support structure 100 comprises a plurality of straight rail sections 14, curved rail sections 28, 30, and planks 20 as in the first embodiment thereof. However, at least some of the planks 20 further comprise legs or support members 102 extending downwardly therefrom such that the scale-model railroad track+may be supported above a surface such as the ground 104.

Each support member 102 preferably comprises a downwardly extending elongate portion 104 and a tip 106. The tip 106 is preferably sufficiently pointed to allow the elongate portion 104 to be urged into soft soil, sand, and the like. Optionally, flat support surfaces or feet (not shown) may be attached at the lower-most portion or tips 106 of the support members 102 such that the second embodiment of the modular support structure of the present invention may be assembled upon a firm surface, i.e., one which is too hard to urge the support members 102 into.

Having described the structure of the second embodiment of the modular support structure for scale-model railroad track of the present invention, it may be beneficial to describe the use thereof. After selecting the desired straight rail sections 14, curved rail sections 28, 30, and planks 20, the modular support structure is assembled by urging the support members 102 of the planks 20 into the ground sufficiently to provide adequate support therefore. It should be noted that not every plank 20 is required to have support members 102 depending therefrom, but rather only that a sufficient number of the planks 20 comprise such support members 102 so as to provide adequate support for the model railroad track and train to be disposed thereon. For example, every other, or every third, plank 20 may comprise support members 102.

Thus, the planks 20 are positioned and urged into the ground, as desired and the straight rail sections 14 and curved rail sections 28 and 30 are disposed therebetween by pressing the single male dovetails 58 thereof into the double female dovetails 42 of the planks 20.

Single-wide planks and Y-planks analogous to those of the first embodiment of the present invention may be utilized to split the double-wide sections into individual tracks, as desired.

It is understood that the exemplary modular support structure for scale-model railroad track described herein and shown in the drawings represents only presently preferred embodiments of the invention. Indeed, various modifications and additions may be made to such embodiments without departing from the spirit and scope of the invention. For example, various shapes and configurations of the rails and planks are contemplated. For example, the rails and/or the planks of the present invention may be configured to have round, triangular, hexagonal, octagonal, etc., cross-sections. Also, various configurations of the suspension members and support members of the first and second embodiments, respectively, are likewise contemplated. Thus, these and other modifications and additions may be obvious to those skilled in the art and may be implemented to adapt the present invention for use in a variety of different applications.

What is claimed is:

1. A modular support structure for scale-model railroad track, comprising:

a) a plurality of planks having first and second ends thereof, said planks comprising double female dovetails formed at the first and second ends thereof;

b) a plurality of suspension members for suspending at least some of said planks from an architectural structure;

c) a plurality of rails interconnecting said planks so as to define a support structure suitable for supporting scale-model railroad track, said rails having first and second ends and comprising complimentary single male dovetails formed at the first and second ends thereof such that abutted male dovetails of two adjacent rails are complimentary to the double female dovetails of said planks; and d) wherein receiving the abutted male dovetails of two adjacent rails within the double female dovetails of said planks facilitates attachment of said rails to said planks such that a modular support structure is provided.

2. The modular support structure for scale-model railroad track as recited in claim 1 wherein said rails comprise:

a) a plurality of straight rails; and b) a plurality of curved rails.

3. The modular support structure for scale-model railroad track as recited in claim 1 wherein said curved rails comprise curved rails of approximately 30 degrees of arc.

4. The modular support structure for scale-model railroad track as recited in claim 1 wherein said planks comprise elongate members having first and second ends, each of said first and second ends being configured to attach two rails such that said planks are disposed intermediate two generally parallel series of rails in a train track-like fashion.

5. The modular support structure for scale-model railroad track as recited in claim 1 wherein:

a) the double female dovetails of said planks are tapered such that they have a greater cross-sectional area at the top thereof than at the bottom thereof;

b) the male dovetails are similarly tapered such that the abutted male dovetails of two adjacent rails are receivable within said double female dovetails; and c) wherein tapering of the double female dovetails of said planks and tapering of the male dovetails of said rails prevents said male dovetails of said rails from falling through the double female dovetails of said planks.

6. The modular support structure for scale-model railroad track as recited in claim 1 wherein said suspension members comprise elongate metal members.

7. The modular support structure for scale-model railroad track as recited in claim 6 wherein said suspension members comprise metal suspension members.

8. The modular support structure for scale-model railroad track as recited in claim 7 wherein:

a) said suspension members comprise threads formed upon one end thereof;

b) at least some of said planks comprise apertures formed therethrough;

c) further comprising a nut threadably engageable to the threads of each suspension member; and d) wherein at least some of said planks are suspended by receiving the threaded end of the suspension member through the aperture formed in at least some of said planks and threading said nut onto said suspension member, said suspension member being attached to an architectural structure.

9. The modular support structure for scale-model railroad rack as recited in claim 1 further comprising at least one Y-plank for splitting a double-wide section of the modular support structure into two single-wide sections thereof, each of said Y-planks comprising:

a) an elongate member having first and second ends;

b) a double female dovetail formed at the first and second ends of said elongate members;

c) two single female dovetails formed intermediate said first and second ends; and d) wherein two rails of a double-wide support section engage one side of the elongate member, and four rails of two single-wide support sections engage the opposite side of the elongate member.

10. A modular support structure for scale-model railroad track, comprising:

a) a plurality of planks having first and second ends thereof, said planks comprising dovetails formed at the first and second ends thereof;

b) a plurality of suspension members for suspending at least some of said planks from an architectural structure;

c) a plurality of rails interconnecting said planks so as to define a support structure suitable for supporting scale-model railroad track, said rails having first and second ends and comprising complimentary dovetails formed at the first and second ends thereof configured to facilitate attachment of said rails to said planks.

11. A modular support structure for scale-model railroad track, comprising:

a) a plurality of planks, said planks comprising elongate members having first and second ends, each of said first and second ends having double female dovetails formed thereon;

b) a plurality of suspension members for suspending at least some of said planks from an architectural structure;

c) a plurality of rails having first and second ends and comprising complimentary single male dovetails formed at the first and second ends thereof such that abutted male dovetails of two adjacent rails are complimentary to the double female dovetails of said planks; and d) wherein receiving the abutted male dovetails of two adjacent rails within the double female dovetails of said planks facilitates attachment of said rails to said planks such that a modular support structure is provided.

12. The modular support structure for scale-model railroad track as recited in claim 11 wherein:

a) the double female dovetails of said planks are tapered such that they have a greater cross-sectional area at the top thereof than at the bottom thereof;

b) the male dovetails are similarly tapered such that the abutted male dovetails of two adjacent rails are receivable within said double female dovetails; and c) wherein tapering of the double female dovetails of said planks and tapering of the male dovetails of said rails prevents said male dovetails of said rails from falling through the double female dovetails of said planks.

13. A modular support structure for scale-model railroad track comprising:

a) a plurality of planks;

b) a plurality of suspension members for suspending at least some of said planks from an architectural structure;

c) a plurality of rails interconnecting said planks so as to define a support structure suitable for supporting scale-model railroad track, said rails being attachable to said planks such that a modular support structure is provided;

d) at least one Y-plank for splitting a double-wide section of the modular support structure into two single-wide sections thereof, each of said Y-planks comprising:

i) an elongate member having first and second ends;

ii) a double female dovetail formed at the first and second ends of said elongate member;

iii) two single dovetails formed intermediate said first and second ends; and iv) wherein two rails of a double-wide support section engage one side of the elongate support and four rails of two single-wide support sections engage the opposite side of the elongate member.

* * * * *